US006699052B1

(12) United States Patent
Poran

(10) Patent No.: US 6,699,052 B1
(45) Date of Patent: Mar. 2, 2004

(54) DUAL VOLTAGE POWER CONVERTER

(75) Inventor: Yehuda Poran, Hazor Haglilit (IL)

(73) Assignee: Epilady 2000 L.L.C., Hatzor Haglilit (IL)

( * ) Notice: Subject to any disclaimer, the term of this patent is extended or adjusted under 35 U.S.C. 154(b) by 0 days.

(21) Appl. No.: 10/267,588

(22) Filed: Oct. 10, 2002

(51) Int. Cl.[7] ..... H01R 29/00
(52) U.S. Cl. ..... 439/172; 439/518; 439/956
(58) Field of Search ..... 439/638, 131, 439/171–174, 956, 640, 518, 177; 363/146, 143, 31, 22

(56) References Cited

U.S. PATENT DOCUMENTS 5,616,051 A * 4/1997 Rogers et al. ..... 439/518
5,634,806 A * 6/1997 Hahn ..... 439/173
5,791,921 A * 8/1998 Lee ..... 439/172
5,973,948 A * 10/1999 Hahn et al. ..... 363/146
6,109,977 A * 8/2000 Baxter et al. ..... 439/693

* cited by examiner

*Primary Examiner*—Hae Moon Hyeon
(74) *Attorney, Agent, or Firm*—Staas & Halsey LLP

(57) ABSTRACT

A power converter includes a transforming unit having pins outwardly projecting from the transforming unit, and a socket. An adapter in the power converter includes a first plug mounted on a first side of the adapter, and a second plug mounted on a second side of the adapter, wherein the socket on the transforming unit receives the first plug or the second plug. Pin cavities on the first side of the adapter, opposite to the second plug, provide a contact to receive the pins to allow the transformer unit to convert an input voltage to an output voltage. Pin cavities on the second side of the adapter, opposite to the first plug, provide a contact to receive one of the pins of the transformer unit to allow the transformer to convert the input voltage to the output voltage.

22 Claims, 7 Drawing Sheets

DUAL VOLTAGE POWER CONVERTER

BACKGROUND OF THE INVENTION

1. Field of the Invention

The present invention relates to a dual voltage power converter, and more particularly, to a bi-voltage power converter including a combination of an adapter and a transformer unit that can be used in different countries around the world.

2. Description of the Related Art

People rely heavily on a wide variety of electrical devices. Almost all of these devices draw power ultimately from a national standard source, usually delivered to a user through a wall outlet or socket. This leads to a challenge for a manufacturer of electrical devices destined for international use; for instance, while many electrical devices are sold for use throughout the world, there is no world standard for electrical plug configurations. Further, it is well known to travelers that electrical voltage supply in the major countries of the world, not only varies in strength of the voltage offered to the user but in a geometry of a socket at a voltage outlet. It has been common for many years for experienced travelers to equip themselves with an electrical adapter having a multiplicity of pins that can be quickly changed to meet various geometries of the voltage outlets. But to meet the various changes in voltage, a separate voltage converter has also been essential.

By the term power or voltage converter is herein meant any device for changing the electrical energy from one strength to another such as a transformer or any electrical or electronic circuit that can produce the same or a similar end result to that of the transformer; or again the converter may be a converter per se in which A.C. is changed to D.C.

Therefore, complexities associated with various voltage conversions are such that these conversions often provide a source of real annoyance and frustration to the traveler. Accordingly, a bi-voltage power converter is essential and mostly convenient for people who travel with their portable electrical devices between countries where the voltages and the plugging systems are different, which can also be useful in Duty-Free shops demos. However, current electronic transformers that can adjust themselves to the right voltage are relatively expensive.

In addition, there are also electro-mechanic transformers where an output voltage is in accordance to an input voltage. However, these transformers may be dangerous because a wrong connection could end in serious damage and safety problems.

SUMMARY OF THE INVENTION

Various objects and advantages of the invention will be set forth in part in the description that follows and, in part, will be obvious from the description, or may be learned by practice of the invention.

To achieve the above and other objects, the present invention provides a power converter, including: a transforming unit including pins outwardly projecting from the transforming unit, and a socket; an adapter including a first plug mounted on a first side of the adapter, and a second plug mounted on a second side of the adapter, wherein the socket on the transforming unit receives the first plug or the second plug; pin cavities on the first side of the adapter, opposite to the second plug, providing a contact to receive the pins to allow the transformer unit to convert an input voltage to an output voltage; and pin cavities on the second side of the adapter, opposite to the first plug, providing a contact to receive one of the pins of the transformer unit to allow the transformer to convert the input voltage to the output voltage.

The present invention provides a power converter, including: a transforming unit including pins outwardly projecting from the transforming unit, a socket, and a transformer; an adapter including a first plug mounted on a first side of the adapter, and a second plug mounted on a second side of the adapter, wherein the socket on the transforming unit receives the first plug or the second plug; pin cavities on the first side of the adapter, opposite to the second plug, providing a contact to receive one of the pins tapping to a primary coil of a first voltage of the transformer to allow the transformer to convert a first input voltage to an output voltage; and pin cavities on the second side of the adapter, opposite to the first plug, providing a contact to receive one of the pins tapping to a primary coil of a second voltage of the transformer to allow the transformer to convert a second input voltage to the output voltage.

To achieve the above and other objects, the present invention further provides a power converter, including: a transforming unit including pins outwardly projecting from the transforming unit, a socket, and a transformer; an adapter including a first plug mounted on a first side of the adapter, and a second plug mounted on a second side of the adapter, wherein the socket on the transforming unit receives the first plug or the second plug; pin cavities on the first side of the adapter, opposite to the second plug, providing a contact to receive one of the pins tapping to a primary coil of about 220-volts of the transformer to allow the transformer to convert an input voltage of about 110-volts to a low DC output voltage; and pin cavities on the second side of the adapter, opposite to the first plug, providing a contact to receive one of the pins tapping to a primary coil of about 110-volts of the transformer to allow the transformer to convert an input voltage of about 220-volts to the low DC output voltage.

These together with other objects and advantages, which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

The above objective and advantage of the present invention will become more apparent by describing in detail preferred embodiments thereof with reference to the attached drawings in which.

DETAILED DESCRIPTION OF THE PREFERRED EMBODIMENTS

Hereinafter, embodiments of the present invention will be described in detail with reference to the attached drawings. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 1:
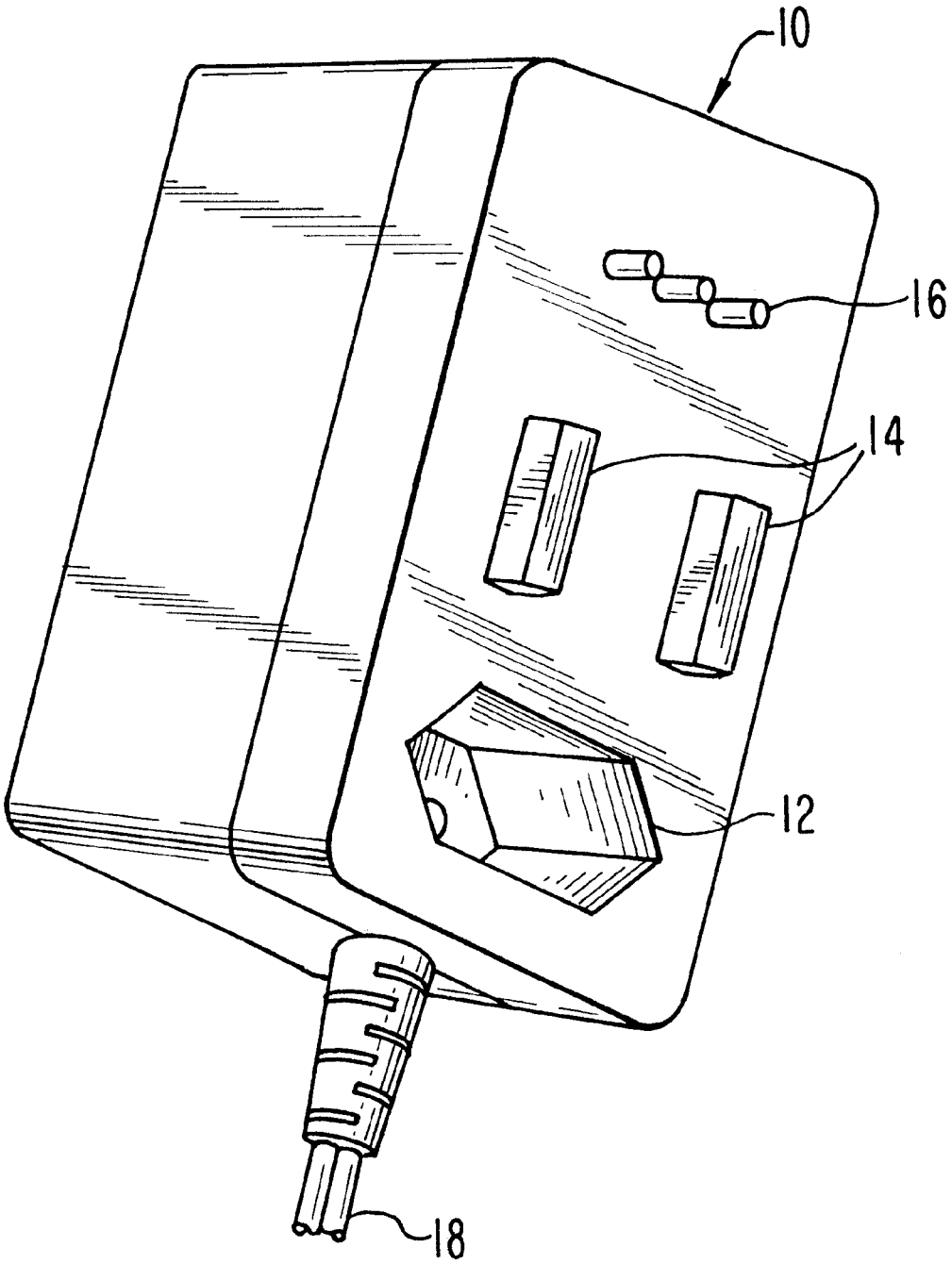
FIG. 1 illustrates a transforming unit in accordance with an embodiment of the present invention.

FIG. 1 illustrates a transforming unit 10 in accordance with an embodiment of the present invention. In FIG. 1, on a front side of the transforming unit 10, a socket 12 is shown adapted to receive a 220-volt plug or 110-volt plug. The transforming unit 10 also includes a pair of locking members 14 that provide a locking mechanism to engage an adapter 20 (to be later described) to the transforming unit 10 and maintain the adapter 20 in a fixed position. Three pins 16 protrude from a surface of the transforming unit 10. Although three pins 16 are shown in this embodiment, the number of pins 16 of the transforming unit 10 may vary. As shown in FIG. 1, the pins 16 may be installed on one end of the front side of the transforming unit 10, the socket 12 may be installed at another end of the front side of the transforming unit 10, and the locking members 14 therebetween.

The pins 16, depending on the type of plug being connected to the socket 12 on the transforming unit 10, connect or tap primary coils of a transformer (not shown) in the transforming unit 10. One pin connects to a common of the transformer, another pin connects or taps to the primary coil of about 120 volts, and another pin connects or taps to the primary coil of about 230 volts to provide 110 volts or 220 volts. That is, the pins 16 allow a physical change of entries of the transformer's primary coils to change an output of the transformer to a low DC output voltage between 3 to 9 volts, for instance. The transformer 10 may receive a variable AC input voltage ranging from about 100 volts to about 240 volts. The transforming unit 10 includes an AC/DC voltage conversion circuitry where the transforming unit 10 would receive a high voltage AC input through the adapter 20 and convert the AC input to a low DC output voltage. The transforming unit 10 provides at an end 18 an operating low DC voltage supply to an electrical apparatus, for instance, connected thereto.

Figure 2:
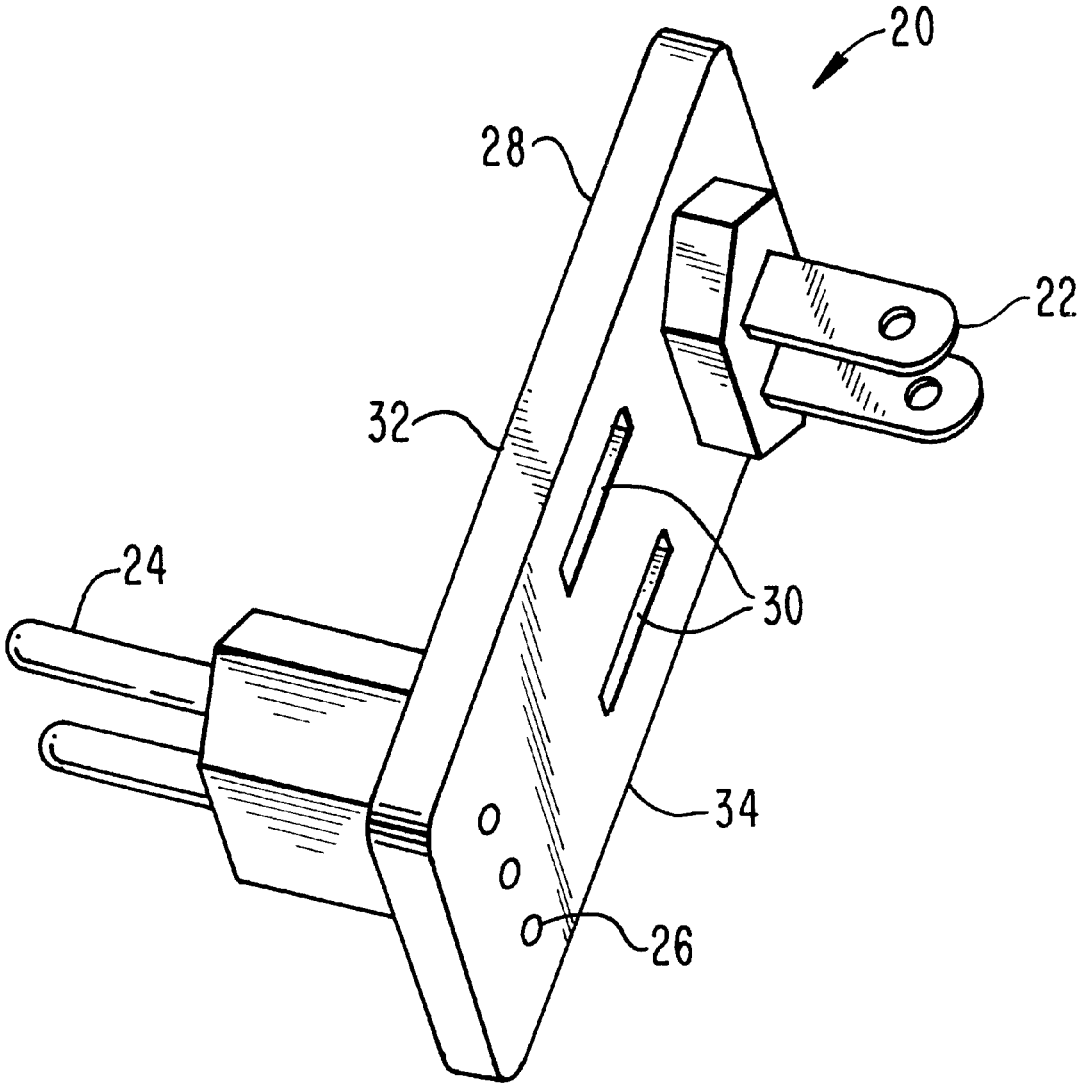
FIG. 2 illustrates a side view of an adapter in accordance with an embodiment of the present invention.

FIG. 2 illustrates a side view of the adapter 20 in accordance with an embodiment of the present invention. As shown in FIG. 2, the adapter 20 is formed as a plate having a predetermined thickness including a 110-volt plug 22, a 220-volt plug 24, pin cavities 26, 28 on opposite ends of each plug, and a pair of locking recesses 30. A shape of the 220-volt plug and a shape of the 110-volt plug have been adapted to be insertable into the socket 12 of the transforming unit 10. Further, although the socket 12 is designed to accommodate the first and second plugs 22, 24 including extended flat pin pair or cylindrical pin pair, an extendable and retractable cylindrical pin pair or three extended flat pins may be adapted to be insertable into the socket 12 of the transforming unit 10.

The 220-volts plug (i.e., a first plug) 24 includes a pair of cylindrically shaped terminals for high voltage, of about 220 volts, and outwardly disposed on a first side 32 and at one end of the adapter 20. The 110-volts plug (i.e., a second plug) 22 includes a pair of elongated rectangular shaped terminals for low voltage, of about 110 volts, and outwardly disposed on a second side 34, opposite to the first plug 24, and at another end of the adapter 20. The pair of locking recesses 30 is place between the first plug 24 and the second plug 22 to interlock with the locking members 14 of the transforming unit 10.

Figure 3:
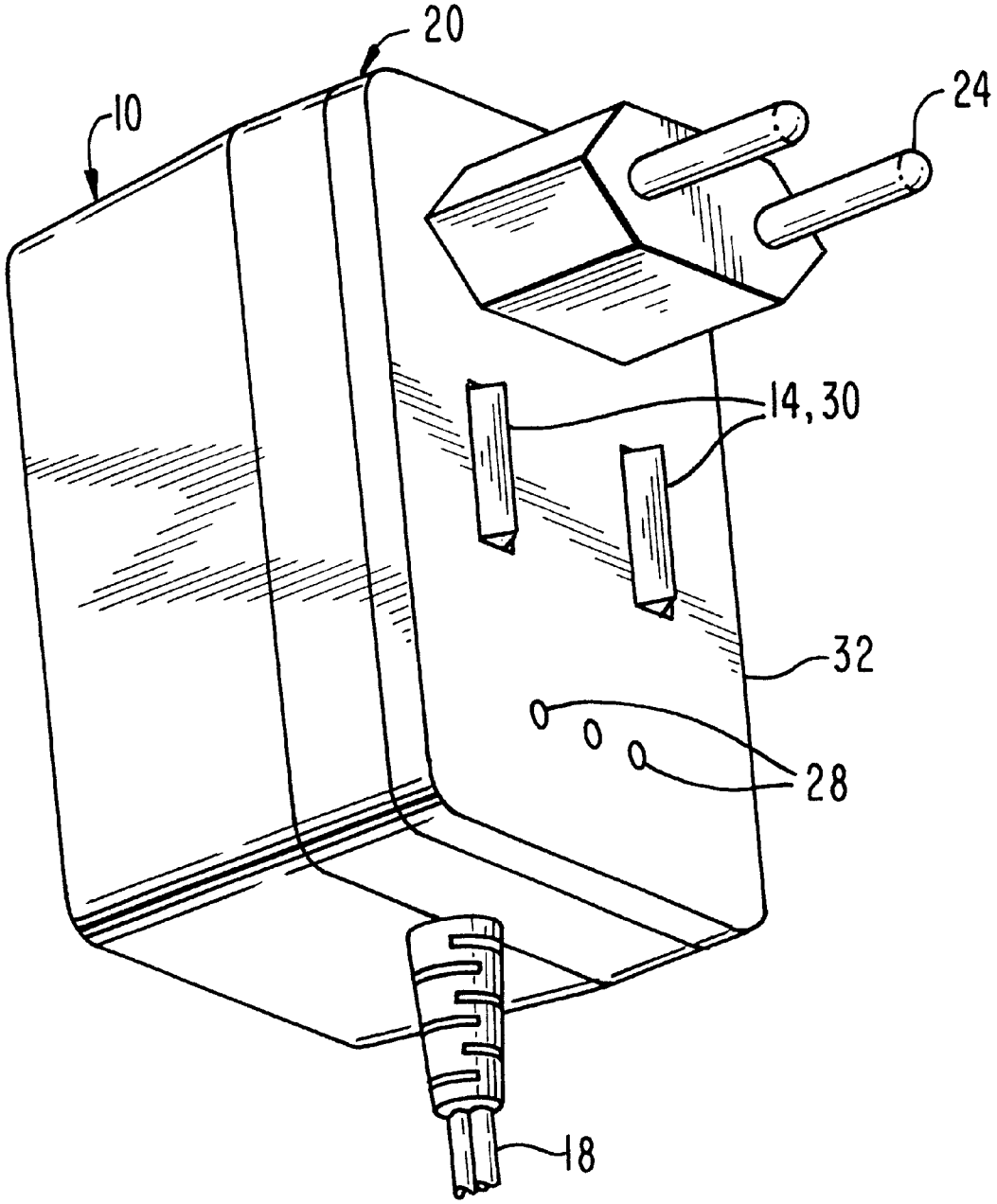
FIG. 3 illustrates the adapter installed on the transformer unit where a first plug on a first side of the adapter is connected to an external power source.

FIG. 3 illustrates the adapter 20 installed on the transformer unit where the first plug 24 (i.e., 220-volts plug) is connected to an external power source, such as a wall socket. The second side 34 of the adapter 20 is facing the transforming unit 10 and the second plug 22 (i.e., 110-volts plug) is plugged into the socket 12 on the transforming unit 10. The locking members 14 lock the adapter 20 to the transforming unit 10.

Further, the pins 16 on the transforming unit 10 plug into the pin cavities 26 on the second side 34 of the adapter 20, opposite to the first plug 24. The pin cavities 26 provide a contact, for instance, to connect to one of the pins 16 tapping to the primary coil of about 220-volts of the transformer in the transforming unit 10; thus, allowing the transformer to convert an input voltage of about 220-volts, for instance, and to supply a low DC output voltage. Another contact may be provided in the pin cavities 26 to connect to the common of the transformer. In an alternative embodiment, contacts may be use as a combination unit of the pins 16 on the transforming unit 10 and the pin cavities 26, 28 on the adapter.

Figure 4:
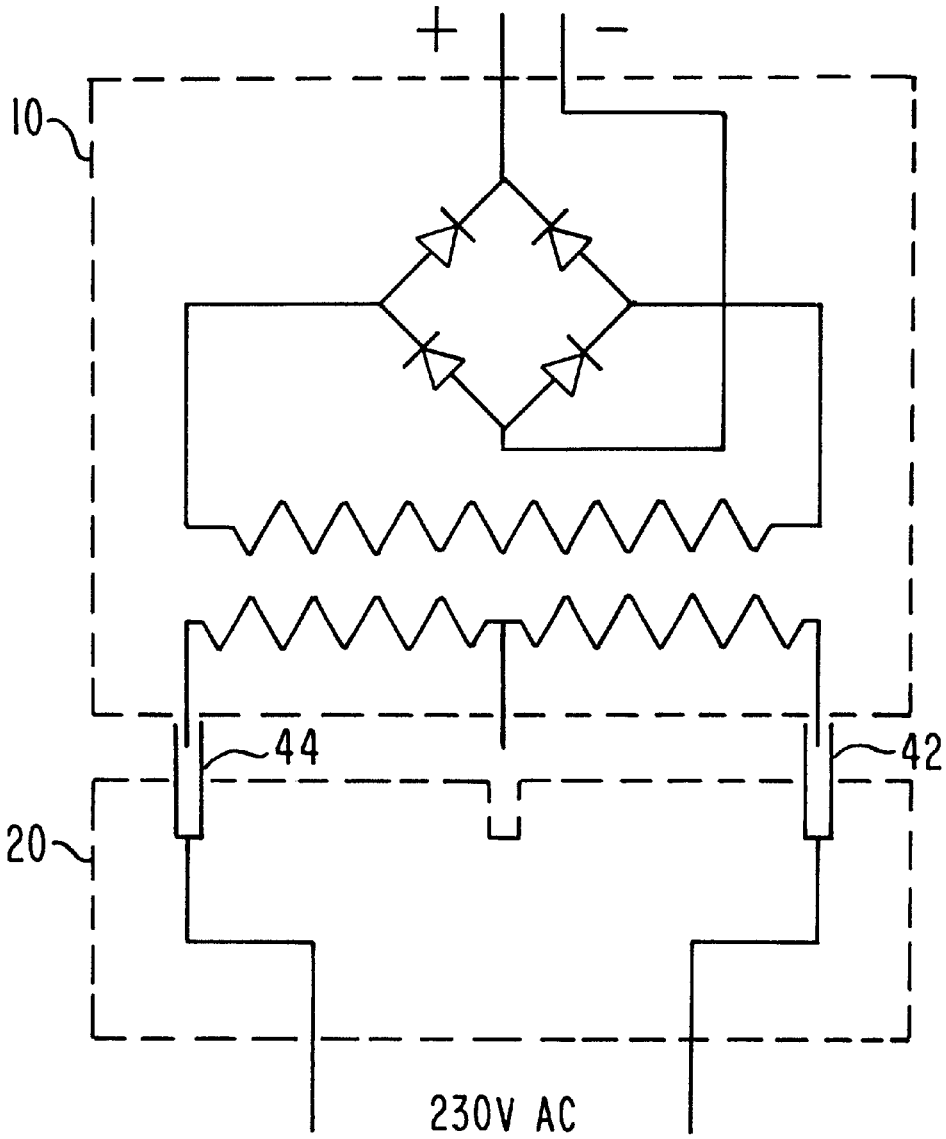
FIG. 4 illustrates a transformer in the transformer unit and the adapter installed on the transformer unit, where the first plug on the first side of the adapter is connected to the external power source.

FIG. 4 illustrates the transformer in the transformer unit 10 and the adapter 20 installed on the transformer unit, where the first plug on the first side of the adapter is connected to the external power source. In one example, on a primary side of the transformer in the transformer unit 10, one pin 42 would connect or tap to the primary coil of about 220 volts and another pin 44 would connect or tap to the common of the transformer to allow a physical change of entries of the transformer's primary coils to change an output of the transformer. The transforming unit 10 includes an AC/DC voltage conversion circuitry where the transforming unit 10 would receive the 220 volts AC through the adapter 20 and convert the 220 volts into a low voltage DC output voltage of using a conventional AC/DC voltage conversion bridge circuitry, for instance.

Figure 5:
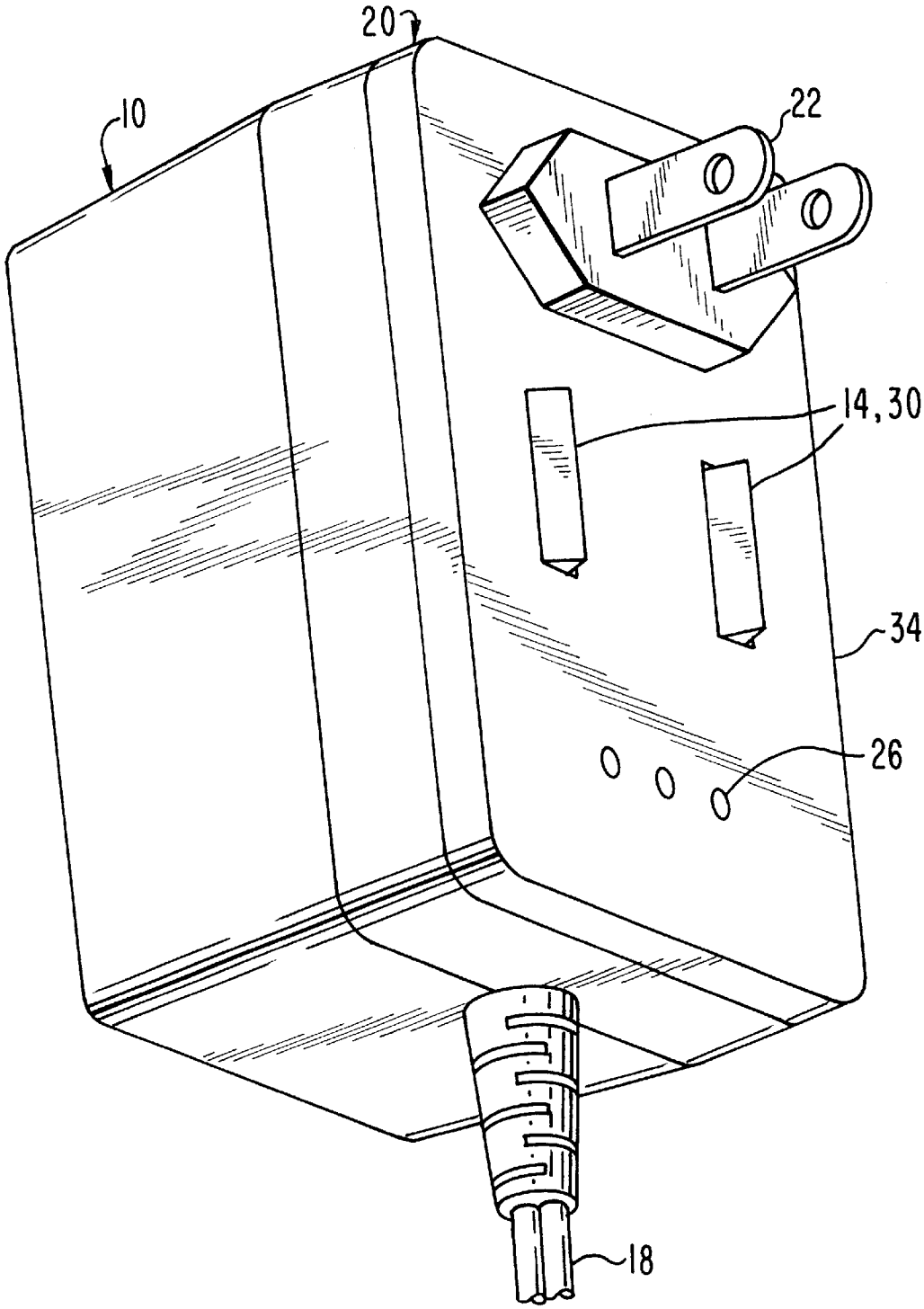
FIG. 5 illustrates the adapter installed on the transformer unit where a second plug on a second side of the adapter is connected to the external power source.

Furthermore, FIG. 5 illustrates the adapter 20 installed on the transformer unit where the second plug 22 on the second side 34 of the adapter 20 is connected to the external power source. The first side 32 of the adapter 20 is facing the transforming unit 10 and the first plug 24 is plugged into the socket 12 on the transforming unit 10. The locking members 14 lock the adapter 20 to the transforming unit 10.

Further, the pins 16 on the transforming unit 10 plug into the pin cavities 28 on the first side 32 of the adapter 20, opposite to the second plug 22. The pin cavities 28 provide a contact, for instance, to connect to one of the pins 16 tapping to the primary coil of about 110-volts of the transformer in the transforming unit 10; thus, allowing the transformer to convert an input voltage of about 110-volts, for instance, and to supply the low DC output voltage. Another contact may be provided in the pin cavities 28 to connect to the common of the transformer.

Figure 6:
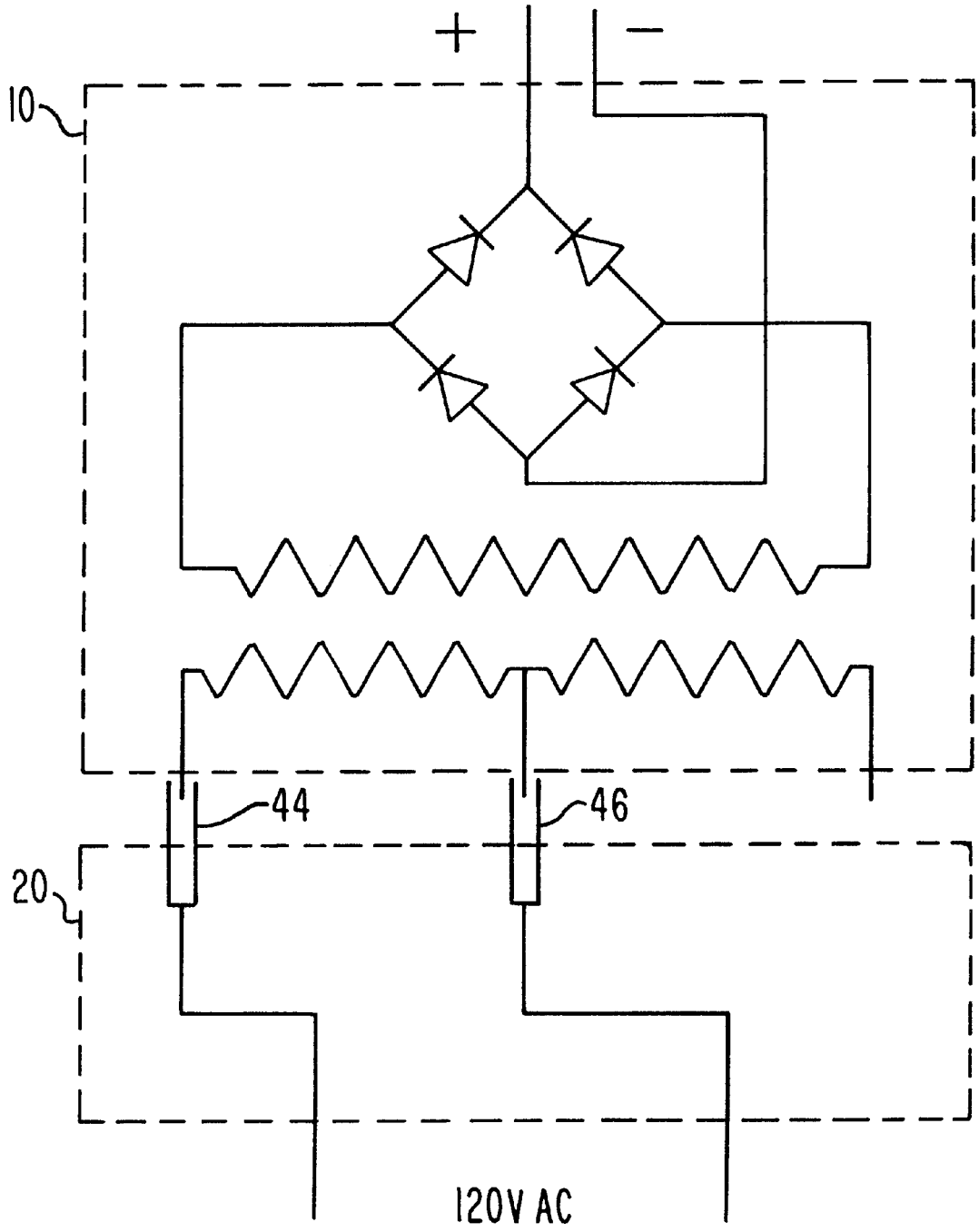
FIG. 6 illustrates the transformer in the transformer unit and the adapter installed on the transformer unit, where the second plug on the second side of the adapter is connected to the external power source.

FIG. 6 illustrates the transformer in the transformer unit and the adapter installed on the transformer unit, where the second plug on the second side of the adapter is connected to the external power source. In one example, on the primary side of the transformer in the transformer unit 10, one pin 46 would connect or tap to the primary coil of about 110 volts and another pin 44 would connect or tap to the common of the transformer to allow a physical change of entries of the transformer's primary coils to change an output of the transformer. The transforming unit 10 includes an AC/DC voltage conversion circuitry where the transforming unit 10 would receive the 110 volts AC through the adapter 20 and convert the 220 volts into a low voltage DC output voltage of using a conventional AC/DC voltage conversion bridge circuitry, for instance.

Figure 7:
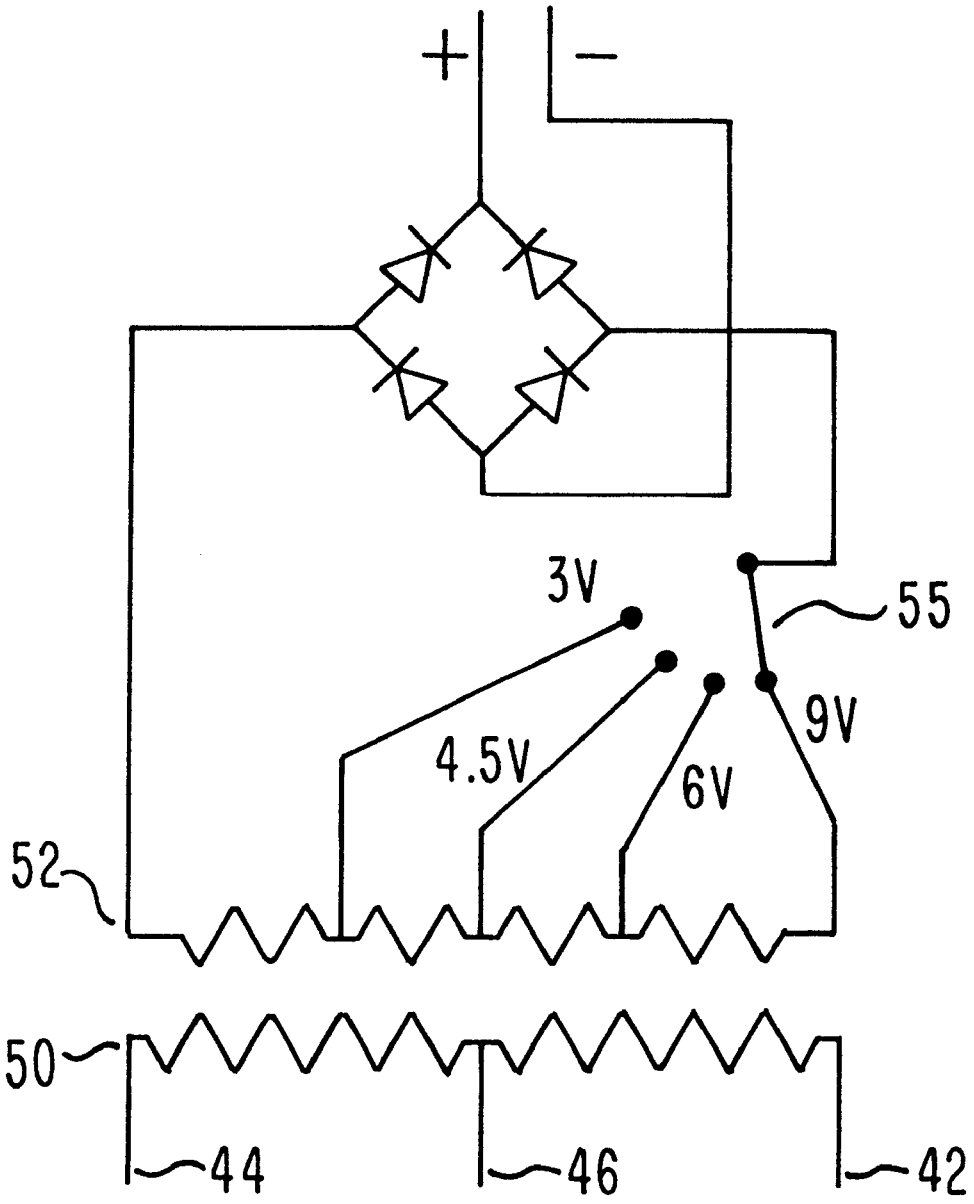
FIG. 7 illustrates the transformer in the transformer unit and the adapter installed on the transformer unit.

FIG. 7 illustrates the transformer in the transformer unit and the adapter installed on the transformer unit. On a primary side 50 of the transformer in the transformer unit 10, one pin 42 connects to the primary coil of about 220 volts, another pin 46 connects to the primary coil of about 110 volts, and another pin 44 connects to the common of the transformer. On a secondary side 52 of the transformer, the AC/DC voltage conversion bridge circuitry is provided. Further, a switch 55 may be coupled to the secondary side of the transformer allowing a user to select a low DC output voltage of, for instance, 3 volts, 4.5 volts, 6 volts, or 9 volts DC, depending on the electrical apparatus to be connected to the transforming unit 10.

As shown in FIGS. 3 and 5, the pin cavities 26, 28 are at one end of the adapter 20 configured to allow a secondary voltage of the transformer in the transforming unit 10 to be a low DC output voltage. Accordingly, the dual voltage power converter, in accordance with an embodiment of the present invention, provides a reliable, safe, and inexpensive device. The converter is standard, portable, and flexible to accommodate to different power supplies around the world.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A power converter, comprising:

a transforming unit comprising pins outwardly projecting from the transforming unit, and a socket;

an adapter comprising a first plug mounted on a first side of the adapter, and a second plug mounted on a second side of the adapter, wherein the socket on the transforming unit receives the first plug or the second plug;

pin cavities on the first side of the adapter, opposite to the second plug, providing a contact to receive the pins to allow the transformer unit to convert an input voltage to an output voltage; and pin cavities on the second side of the adapter, opposite to the first plug, providing a contact to receive one of the pins of the transformer unit to allow the transformer to convert the input voltage to the output voltage.

2. The power converter as recited in claim 1, wherein the input voltage is an AC input voltage of about 220 volts or about 110 volts and the output voltage is a low DC output voltage.

3. The power converter as recited in claim 2, wherein the low DC output voltage is between 3 to 9 volts.

4. The power converter as recited in claim 1, wherein each of the first and second plugs is at opposite ends of the adapter.

5. The power converter as recited in claim 2, wherein the first plug is a 220-volts plug and the second plug is a 110-volts plug.

6. The power converter as recited in claim 1, the transforming unit further comprising:

a locking mechanism to engage the adapter to the transforming unit and maintain the adapter in an operable position.

7. The power converter as recited in claim 1, wherein the first and second plugs are different from each other and comprise one of a flat pin pair, a cylindrical pin pair, an extendable and retractable cylindrical pin pair, and three extended flat pins.

8. A power converter, comprising:

a transforming unit comprising pins outwardly projecting from the transforming unit, a socket, and a transformer;

an adapter comprising a first plug mounted on a first side of the adapter, and a second plug mounted on a second side of the adapter, wherein the socket on the transforming unit receives the first plug or the second plug;

pin cavities on the first side of the adapter, opposite to the second plug, providing a contact to receive one of the pins tapping to a primary coil of a first voltage of the transformer to allow the transformer to convert a first input voltage to an output voltage; and pin cavities on the second side of the adapter, opposite to the first plug, providing a contact to receive one of the pins tapping to a primary coil of a second voltage of the transformer to allow the transformer to convert a second input voltage to the output voltage.

9. The power converter as recited in claim 8, wherein the first voltage and the first input voltage are AC voltages comprising about 110-volts, the second voltage and the second input voltage are AC voltages comprising about 220-volts, the first plug is a 220-volts plug, and the second plug is a 110-volts plug.

10. The power converter as recited in claim 9, wherein the output voltage is a low DC output voltage.

11. The power converter as recited in claim 10, wherein when the socket receives the 220-volts plug, the 110-volts plug is connected to an external power source providing about 110-volts, and the pin cavities on the first side of the adapter receive one of the pins tapping to the primary coil of 110-volts of the transformer to allow the transformer to convert the first input voltage of about 110-volts to the low DC output voltage.

12. The power converter as recited in claim 10, wherein when the socket receives the 110-volts plug, the 220-volts plug is connected to an external power source providing about 220-volts, and the pin cavities on the second side of the adapter receive one of the pins tapping to the primary coil of 220-volts of the transformer to allow the transformer to convert the second input voltage of about 220-volts to the low DC output voltage.

13. The power converter as recited in claim 10, further comprising:

a switch coupled to a secondary side of the transformer allowing a user to select the low DC output voltage comprising one of 3 volts, 4.5 volts, 6 volts, and 9 volts.

14. The power converter as recited in claim 8, the transforming unit further comprising:

a locking mechanism to engage the adapter to the transforming unit and maintain the adapter in an operable position.

15. The power converter as recited in claim 8, wherein the first and second plugs are at opposite ends of the adapter.

16. The power converter as recited in claim 8, wherein the first and second plugs are different from each other and comprise one of a flat pin pair, a cylindrical pin pair, an extendable and retractable cylindrical pin pair, and three extended flat pins.

17. A power converter, comprising:

a transforming unit comprising
pins outwardly projecting from the transforming unit,
a socket, and
a transformer;

an adapter comprising
a first plug mounted on a first side of the adapter, and
a second plug mounted on a second side of the adapter, wherein the socket on the transforming unit receives the first plug or the second plug;

pin cavities on the first side of the adapter, opposite to the second plug, providing a contact to receive one of the pins tapping to a primary coil of about 220-volts of the transformer to allow the transformer to convert an input voltage of about 220-volts to a low DC output voltage; and pin cavities on the second side of the adapter, opposite to the first plug, providing a contact to receive one of the pins tapping to a primary coil of about 110-volts of the transformer to allow the transformer to convert an input voltage of about 110-volts to the low DC output voltage.

18. The power converter as recited in claim 17, wherein the low DC output voltage is between 3 to 9 volts.

19. The power converter as recited in claim 17, the transforming unit further comprising:

a locking mechanism to engage the adapter to the transforming unit and maintain the adapter in an operable position.

20. The power converter as recited in claim 17, wherein the first and second plugs are at opposite ends of the adapter.

21. The power converter as recited in claim 17, wherein the first and second plugs are different from each other and comprise one of a flat pin pair, a cylindrical pin pair, an extendable and retractable cylindrical pin pair, and three extended flat pins.

22. The power converter as recited in claim 17, further comprising:

a switch coupled to a secondary side of the transformer allowing a user to select the low DC output voltage comprising one of 3 volts, 4.5 volts, 6 volts, and 9 volts.

* * * * *